US005295688A

United States Patent [19]

Montgomery

[11] Patent Number: 5,295,688

[45] Date of Patent: Mar. 22, 1994

[54] GOLF CLUB GRIP POSITIONING DEVICE

[76] Inventor: Robert Montgomery, 1211 Roebuck Ct., West Palm Beach, Fla. 33401

[21] Appl. No.: 873,289

[22] Filed: Apr. 23, 1992

[51] Int. Cl.[5] ..... A63B 53/14; A63B 69/36

[52] U.S. Cl. ..... 273/165; 273/187.5

[58] Field of Search ..... 273/165, 187.5, 163 R, 273/163 A, 81 D, 81 B

[56] References Cited

U.S. PATENT DOCUMENTS 3,256,023 6/1966 Frazelle ..... 273/165

5,143,375 9/1992 Wilkins ..... 273/165 X

*Primary Examiner*—George J. Marlo

*Attorney, Agent, or Firm*—Malin, Haley, DiMaggio & Crosby

[57] ABSTRACT

A thumb alignment grip guide is provided for attachment to a golf club handle. The thumb guide acts as a stop or barrier for preventing movement of the golfer's thumb during the golf swing, and allows a golfer to correctly grip the handle at the proper angular location with the lower hand for an accurate golf swing to have the club face contact the ball at the proper angle. The golfer grabs the handle and aligns and presses his or her thumb of the lower hand on the grip against the thumb guide. In one embodiment, the thumb barrier can be pivoted out of the way against the handle or removed when not in use.

2 Claims, 1 Drawing Sheet

GOLF CLUB GRIP POSITIONING DEVICE

BACKGROUND OF THE INVENTION

1. Field of the Invention

This invention relates generally to the game of golf and more particularly to a golf club guide which allows a golfer to grip a respective golf club in the same spot each time for an improved golf swing.

2. Description of the Prior Art

In playing the game of golf, having a proper and consistent golf swing is essential to prevent hooking or slicing of the golf ball during the golf swing. To aide a golfer during his swing several guides have been designed in the past. U.S. Pat. No. 5,009,426 to Cox shows a golf club guide which attaches to a golf club shaft and provides an abutment which continuously engages the user's trailing forearm during both the backswing and follow-through positions, in order to maintain operative alignment between the golf club and the user's trailing arm as the golf club is swung through the backswing and follow-through positions. Cox discloses a device which prevents wrist movement.

U.S. Pat. No. 5,018,734 to Allsop shows a projecting contact member attached to a tennis racket and having a rounded outer end adapted to fit comfortably into the "V" between the thumb and index finger of a player. In use, the rigid handle position of the tennis racket is loosely held in the player's hand. The thumb and first finger locate around the contact member. As the hand of the player is rotated, the contact member is carried with the thumb and finger to a desired angular position, using indicia on the racket and/or the sensation of a ball engaging detent as a guide. As seen in FIG. 8 of Allsop, the contact member or block consumes a relatively large cross-sectional area of the top surface of the tennis racket in order to allow the contact member to comfortably fit into the "V" between the thumb and index finger of a player.

U.S. Pat. No. 4,361,326 to Kokes shows a pad or closed cell foam rubber material or the like which is fixed to a golf club grip in a position to be held by the lower hand of the golfer. The pad is adapted to absorb energy from the lower hand during a golf swing to prevent overpowering of the club by the lower hand. The pad includes a layer of closed cell foam rubber and a pressure sensitive adhesive to affix the pad to the golf club grip.

U.S. Pat. No. 4,795,158 to Kuykendall shows a golf putter comprising a putter blade or head having a forwardly-angled striking face to impart immediate overspin to the ball being struck. The putter includes a relatively large square handle or grip for enabling alignment of the palm head with the projected line of ball travel.

U.S. Pat. No. 3,687,458 to Proctor, Jr. shows a pivot member at the upper end of a golf club shaft, which is biased outwardly by a compression spring and is adapted to be squeezed by the uppermost hand of the user and moved against the fixed semicylindrical portion of the shaft to provide a generally cylindrical grip portion. If the gripping force exerted by the golfer's hand is not sufficient to compress the spring and force the pivoted member against the shaft, an awkward and uncomfortable grip portion is provided which prevents the golfer from swinging the club in the proper manner.

What is needed in the art is a device or apparatus for resting the outside portion of a golfer's thumb while the golfer is gripping the golf club in order for the golfer's hands to be aligned with the golf club head, thus allowing the golf club head to hit the golf ball at the same angle each time. It is, therefore, to the effective resolution of the aforementioned problems and shortcomings that the present invention is directed.

SUMMARY OF THE INVENTION

Generally, the instant invention provides a relatively thin grip guide member that firmly attaches to a golf club handle. A right handed golfer normally uses a two hand in-line interlocked grip with the right hand below the left hand. The proper angular position of the hands relative to the shaft is necessary to ensure that the club face strikes the ball at the correct angle. When a golfer grips the golf club handle and presses his thumb against the thumb stop guide member, the golfer's thumb and consequently hands are aligned with the golf club head, thus allowing the golfer to hit the golf ball at the same club face angle each time. The guide member can be rotated by degrees to correct the angle the club head hits the golf ball to correct from hooking or slicing the ball. In one embodiment the guide member is permanently attached to the golf club handle. In a second embodiment the guide member is hingedly connected to the golf club handle to allow the guide member to folded when not in use. In a third embodiment the guide member is removably connected to the golf club handle.

Accordingly, the primary object of the instant invention is to a grip guide apparatus for allowing a golfer to determine optimum hand shaft/club face alignment and grip the golf club handle in the same optimum position each time in order to insure a consistent golf swing.

Another object of the instant invention is to provide a grip guide apparatus for allowing a golf club head to hit a golf ball at the same angle each time the golf club is swung.

Still another object of the instant invention is to provide a hand-shaft grip guide apparatus which prevents a golf club from twisting in a golfer's hands when a golf ball is hit.

Still another object of the instant invention is to provide a grip guide apparatus which can be rotated by degrees to change the angle of a golf club head in relation to a golfer's hands holding the golf club.

Still another object of the instant invention is to provide a grip guide apparatus which fits on all golf club handles.

Still another object of the instant invention is to provide a grip guide apparatus which does not interfere in returning a golf club to a golf bag after use of such club.

Still another object of the instant invention is to provide a grip guide apparatus which is relatively low in cost and easy to manufacture.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to the drawings in which.

PREFERRED EMBODIMENTS OF THE INVENTION

Figure 1:
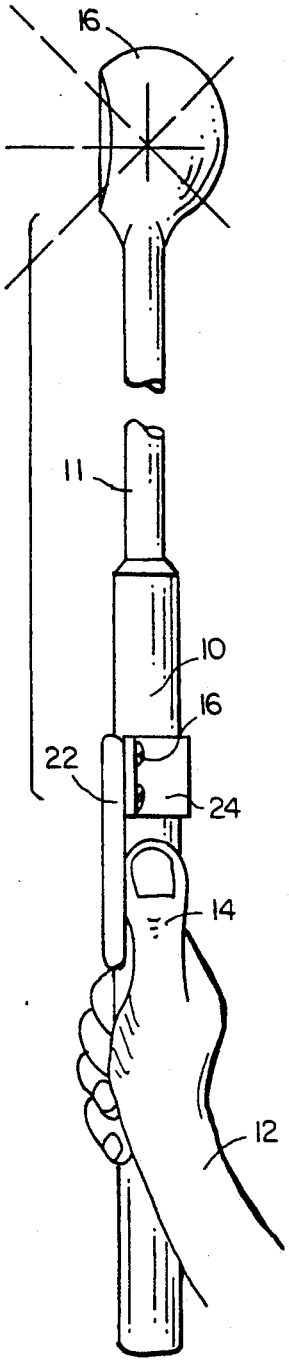
FIG. 1 is a top plan view partially cut away of a golf club including shaft handle of a first embodiment of the instant invention shown with a single hand grip by the user.

Now referring to FIG. 1, the invention 10 is shown attached to a golf club shaft handle 12. The invention 10 includes an L-shaped plate that acts as a thumb stop having first leg portion 23 and a second leg portion 25. Thumb stop 22 is flat and has a relatively thin thickness as compared to handle 12 diameter. Though thumb stop 22 is shown as a flat L-shaped member, it is to be understood that other thumb barrier configurations can be utilized for thumb stop 22. If thumb stop 22 is properly aligned relative to the shaft and club face, when the golfer's thumb is pressed against the stop 22, the golfer's grip should be correct. Clamp band 24 is attached to the thumb stop 22 by threaded bolts 26 and 28 screwed into apertures in the thumb stop 22. When attached to each other, thumb stop 22 and clamp band 24 define a passage 27. Shaft handle 12 can be inserted through passage 27 until thumb stop 22 is disposed at a desired location longitudinally along handle 10. Clamp band 24 is tightened by bolts 26 and 28 to secure thumb stop 22 to the shaft handle 12.

Once firmly attached on handle 12, thumb, stop 22 acts as barrier locator or marker to allow a golfer's lower right hand to grab handle 12 of golf club 11 at the same relative angular club face location each time. Additionally, clamp band 24 can also serve as an additional marking for placement of golfer's right hand along the length of handle 12. When the golfer grabs handle 12, he or she places the outside portion of their thumb 14 against leg portions 25 of thumb stop 22. Additionally, the tip of thumb 14 can rest against the edge of clamp band 24 to provide further alignment marker. Thus, when gripping the handle, thumb 14 rests against thumb stop 22 to align golfer's thumb and right hand with golf club head 16 at a prefixed angle. Therefore, a golfer is ensured a properly aligned golf grip each time to allow a golfer the opportunity to hit the golf ball at the same angle every time.

The thumb stop 22 can be manually moved along and around handle 12 by loosening clamp band 24 to change the contact planar angle that golf club head face 16 contacts the golf ball. Adjusting thumb stop 22 through a rotational angle in either direction around handle 12 changes the angle that golf club head face 16 contacts the golf ball and also changes the angle of the golf club head 16 in relation to golfer's hands holding golf club 11. Thus, hooking or slicing, when not hitting the golf ball at the proper club face angle, can be corrected. Additionally, thumb stop 22 prevents golf club 11 from twisting in a golfer's hands from the force of golf club head 16 hitting the golf ball.

The thumb stop 22 does not interfere with the golfer's hands when gripping handle 12. Additionally, by loosening or tightening clamp band 24, thumb stop 22 can securely fit on handles of various size diameters. Thus, the thumb stop 22 provides a quick and easy way to improve a golf swing and to ensure a consistent golf swing each time.

Figure 2:
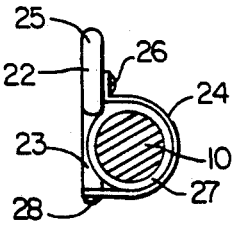
FIG. 2 is a front elevational view in cross section taken along the line A—A of FIG. 1.
Figure 3:
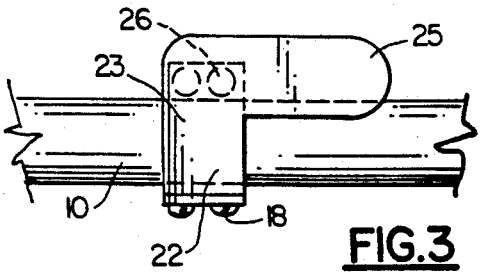
FIG. 3 is a side elevational view of the first embodiment of the instant invention shown attached to a golf club handle partially cut away.
Figure 4:
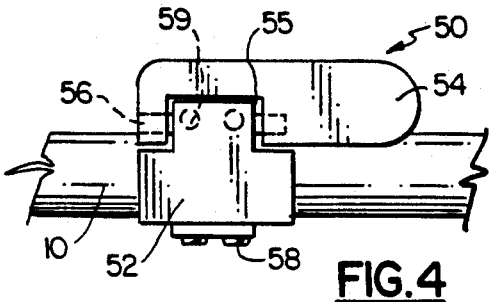
FIG. 4 is a side elevational view of a second embodiment of the instant invention shown in an up position.
Figure 5:
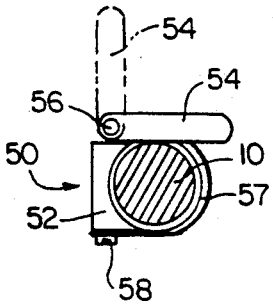
FIG. 5 is a front elevational view partially in cross section of the second embodiment of the instant invention shown in an up position by phantom lines and in a down or folded position.

A second embodiment of the present invention is generally shown in FIGS. 4 and 5. Thumb stop 50 is shown comprising a shaft attaching plate 52 and a movable rigid barrier 54 hingedly connected by a pin 56 directed through apertures in plate 52 and barrier 54. Barrier 54 is relatively thin in thickness as compared to the diameter of handle 12. Thumb stop 50 is attached to handle 12 by clamp band 57 by threaded fasteners 58 and 59 that fit female apertures in plate 52 at top and bottom. As seen in phantom in FIG. 5 when in use, barrier 54 is moved and positioned in an upward, somewhat outwardly position, tangent to handle 12. In such extended position, thumb stop 50 functions to align the lower hand thumb angularly relative to the handle 12 and can be angularly and longitudinally adjusted around and along handle 12 by loosening clamp band 57.

Many golf club bags (not shown) have elongated hollow storage tubes located within for organizing the individual golf clubs within the bag. Typically, each hollow tube has a diameter only slightly larger than the handle of each golf club for a compact array within the golf bag. Thus, any attachment to a golf club handle must be relatively small in diameter, to allow the golf club to still be inserted with the tube. Accordingly, when not in use, thumb barrier 54 is folded down until it abuts handle 12. In such downward position, the diameter of grip guide 50 is reduced, to allow a golf club 11 having thumb stop 50 attached to handle 12, to be properly inserted into its designated tube in a golf club bag.

Figure 7:
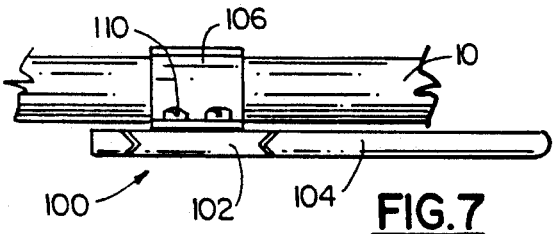
FIG. 7 is a bottom plan view of the third embodiment of the instant invention attached to a golf club shaft partially cut away.
Figure 6:
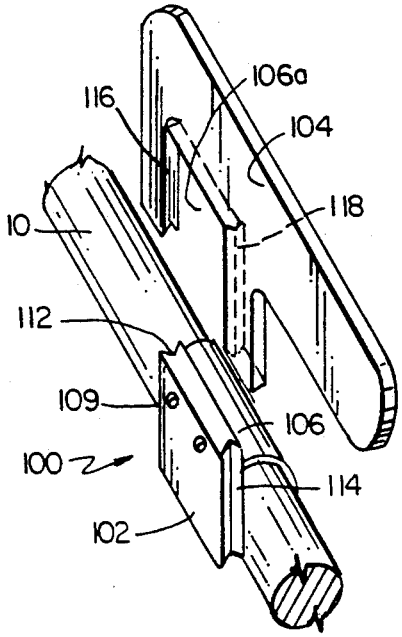
FIG. 6 is a perspective view of a third embodiment of the instant invention.

A third embodiment of the present invention is shown in FIGS. 6 and 7. Thumb stop 100 is shown comprising shaft connector 102 and an L-shaped plate having a U-shaped recess that is a thumb barrier 104. Barrier 104 is rigid (metal or plastic) and relatively thin in thickness as compared to handle 12. Shaft connector 102 is attached to handle 12 by clamp band 106 threaded fasteners 109 and 110 that fasten in threaded female apertures (not shown) in band 106 and connector 102. Connector 102 includes parallel grooves or slots 112 and 114 located at each end of connector 102. Barrier 104 defines a U-shaped recess 106*a* having tapered end walls 116 and 118 corresponding in shape to mate with slots 112 and 114 respectively. Recess 106*a* is sized to frictionally receive connector 102 and to allow barrier 104 and connector 102 to be tightly, but removably, attached to each other.

When connector 102 and barrier 104 are attached to each other, thumb stop 100 functions to align the thumb on the lower hand of the golf grip angularly with the club shaft and club head face in the proper position. However, when the thumb stop is not in use, barrier 104 is removed from connector 102 and handle 12 to allow the golf club to be properly inserted into its respective tube in the golf club bag. Thumb stop 100 is adjustable angularly around and longitudinally along handle 12 by loosening clamp band 106. The present invention can be both a physical barrier for the thumb and a tactile reference as the thumb rests against the thumb barrier. Tactile bumps may also be used in lieu of the barrier.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. An apparatus used for preventing a golfer's thumb from moving as well as for accurate positioning of a golfer's thumb and lower hand grip on a handle of a golf club during a golf swing, comprising: a relatively thin rigid thumb guide member mounted on the handle and moveable between an in-use position and a non-use position, the thumb having an outer portion resting and touching adjacent said thumb guide member when said thumb guide member is in the in-use position, to properly align the golfer's hand grip on the handle and to prevent the thumb from moving during the golf swing, said guide member including a first portion and a second portion, said first portion and said second portion hingedly connected to each other by a pin, said pin permitting rotative movement of said second portion from a first, operative position, wherein said second portion is in the same vertical plane as said first portion, to a second and inoperative position, said second portion, when in said inoperative position, substantially abutting the handle to facilitate storage of the golf club in a golf bag, said second portion acting as a physical barrier for the thumb when said second portion is in the operative position, said second portion further being sized in width, length, and height to conform to the thumb of a golfer; and means for attaching said thumb guide member to the handle; wherein when in said operative position, said second portion depends outwardly from the handle to form a stop for the golfer's thumb and allows the outside portion of the golfer's thumb to rest against said second portion to provide correct positioning of the golfer's lower hand during the golf swing.

2. The apparatus of claim 1, wherein said means for attaching said guide member is a clamp member.

* * * * *